US005529286A

United States Patent [19]

Kikuchi

[11] Patent Number: 5,529,286

[45] Date of Patent: Jun. 25, 1996

[54] JACK

[75] Inventor: Noriyuki Kikuchi, Saitama, Japan

[73] Assignee: Rikenkaki Kogyo Kabushiki Kaisha, Saitama, Japan

[21] Appl. No.: 419,389

[22] Filed: Apr. 10, 1995

[30] Foreign Application Priority Data

May 10, 1994 [JP] Japan ..... 6-096405
Nov. 16, 1994 [JP] Japan ..... 6-282199

[51] Int. Cl.[6] ..... B66F 3/08

[52] U.S. Cl. ..... 254/126

[58] Field of Search ..... 254/126, 122, 254/8 B, 9 B, 10 B, 124

[56] References Cited

U.S. PATENT DOCUMENTS 4,771,986 9/1988 Nasu ..... 254/126
5,346,180 9/1994 Popowich ..... 254/126
5,356,117 10/1994 Engel ..... 254/126

FOREIGN PATENT DOCUMENTS 55-46718 11/1980 Japan .

*Primary Examiner*—Robert C. Watson

*Attorney, Agent, or Firm*—Nikaido, Marmelstein, Murray & Oram

[57] ABSTRACT

In a pantagraph type jack, a pair of side plate portions are provided at an upper end of each lower arm, and a pair of side plate portions are provided at a lower end of each upper arm, the pairs of side plate portions being superposed on each other. Outer one of the side plate portions has an insertion hole provided therein, and inner one of the side plate portions has a support sleeve portion formed thereon by burring and coaxially connected to the insertion hole and extending inwardly. The connecting shaft is formed with its outside diameter uniform over the entire axial length, and has bulged portions formed by caulking at its opposite ends inserted through the insertion holes and the support sleeve portions, which bulged portions are engaged with the outer side plate portions. In a Y-type jack, a pair of opposed side plate portions are provided at an upper end of a lower arm. A supporting sleeve portion is formed on the side plate portion by burring to extend inwardly. The connecting shaft is formed with its outside diameter uniform over the entire axial length, and has bulged portions formed by caulking at its opposite ends inserted through the insertion holes and the support sleeve portions, which bulged portions are engaged with the side plate portions.

4 Claims, 8 Drawing Sheets

JACK

FIELD OF THE INVENTION

The present invention relates to a so-called pantagraph type jack including a pair of lower arms swingably connected at their lower ends to a pedestal, a pair of upper arms connected at their lower ends to a upper ends of the lower arms through connecting shafts respectively and having a load receiving block at their upper ends, and a threaded rod fitted into one of the connecting shafts with an axial relative position therebetween maintained constant to permit the movement of the pair of connecting shafts interconnecting the lower and upper arms toward and away from each other, as well as to a so-called Y-type jack including a lower arm swingably connected at its lower end to a pedestal, an upper arm swingably connected at its lower end to an intermediate portion of the lower arm and having a load receiving block at its upper end, a first connecting shaft rotatably carried at an upper end of the lower arm, a second connecting shaft rotatably carried at the upper end of the upper arm, and a threaded rod threadedly inserted into the first connecting shaft to permit the movement of the first and second connecting shafts toward and away from each other and fitted into the second connecting shaft with a relative position maintained constant.

DESCRIPTION OF THE PRIOR ART

In such prior art jacks, the connecting shaft is connected to a link in a structure as disclosed, for example, in Japanese Patent Publication No. 46718/80.

In the above jack, the connecting shaft is formed in a stepped structure, so that its axially opposite ends have a smaller diameter. The smaller diameter portions at the opposite ends of the connecting shaft are caulked so that they are engaged with an outer surface of the arm. In such structure, however, the manufacture cost is increased in order to form the connecting shaft in the stepped structure. Moreover, insertion holes for insertion of the connecting shafts are only provided at the side of the arms, and the inward movement of the arms in an axial direction of the connecting shafts is not limited. For this reason, there is a strength problem that the arm may fall down inwardly in the axial direction of the connecting shaft at a portion having the insertion hole provided therein depending upon an increase in applied load.

SUMMARY OF THE INVENTION

Accordingly, it is an object of the present invention to provide a jack wherein the connecting shaft is formed with a simple shape to provide a reduction in manufacture cost and an increase in strength of the arm at a portion corresponding to the connecting shaft.

To achieve the above object, according to an aspect and feature of the present invention, there is provided a jack comprising: a pair of lower arms swingably connected at their lower ends to a pedestal; a pair of upper arms connected at their lower ends to upper ends of the lower arms through a pair of connecting shafts, respectively and having load receiving blocks at upper ends of the upper arms; and a threaded rod fitted into one of the connecting shafts with an axial relative position maintained constant and threadedly inserted in the other connecting shaft such that the pair of connecting shafts interconnecting the lower and upper arms can move toward and away from each other, wherein each of the upper end of the lower arm and the lower end of the upper arm is provided with a pair of side plate portions, the pairs of side plate portions being superposed on each other, outer one of the side plate portions having an insertion hole, inner one of the side plate portions having a support sleeve portion formed by burring and coaxially connected to the insertion hole to extend inwardly, each of the connecting shafts being formed to have a uniform outer diameter over its entire axial length and inserted through the insertion hole and the support sleeve portion, and each of the connecting shafts being formed at its opposite ends projected from the outer side plate portion with bulged portions by caulking for engaging with the outer side plate portion.

With such construction, it is possible to reduce a manufacturing cost by using the connecting shafts of a simple shape and a substantially uniform diameter over its entire axial length, and moreover, it is possible to set the area of contact between the side plate portion located at an inner side and the connecting shaft at a large value to increase the strength to an applied load.

According to another feature of the present invention, the connecting shaft, into which the threaded rod is fitted with the axial relative position maintained constant, is formed into a hollow cylindrical shape. Thus, it is possible to provide a reduction in weight of the connecting shaft and in its turn, to provide a reduction in weight of the jack.

According to a further feature of the present invention, the jack further includes a thrust bearing interposed between the hollow cylindrical connecting shaft and a handle joint provided at one end of the threaded rod, and a receiving seat formed, by pressing, into a radially inwardly recessed shape on an outer surface of the connecting shaft on an opposite side from the thrust bearing for receiving a stopper projectingly provided on the threaded rod, such that the rotation of the stopper generated by the rotation of the threaded rod is permitted.

Thus, a structure for maintaining constant the axial relative position of the threaded rod to the connecting shaft can be easily formed by utilizing the fact that the connecting shaft is hollow.

According to a yet further feature of the present invention, the stopper is formed by caulking to protrude from the outer surface of the threaded rod. Thus, it is possible to extremely easily form the stopper.

According to another aspect and feature of the present invention, there is provided a jack comprising: a lower arm swingably connected at its lower end to a pedestal; an upper arm swingably connected at its lower end to an intermediate portion of the lower arm and having a load receiving block at an upper end of the upper arm; a first connecting shaft rotatably carried at an upper end of the lower arm; a second connecting shaft rotatably carried at the upper end of the upper arm; and a threaded rod threadedly inserted into the first connecting shaft to permit the movement of the first and second connecting shafts toward and away from each other and fitted into the second connecting shaft with a relative position maintained constant, wherein the lower arm is provided at its upper end with a pair of opposed side plate portions which are formed with supporting sleeve portions by burring to extend inwardly, and the first connecting shaft is formed to have a uniform diameter over its entire axial length and inserted through the supporting sleeve portions, the first connecting shaft being formed, by caulking, with bulged portions at its opposite ends which are protruded from the opposite side plate portions, the bulged portions being engaged with the opposite side plate portions.

With the above construction, it is possible to produce the first connecting shaft of a simple shape with a uniform diameter over the entire axial length by cutting a rounded rod material to reduce the manufacture cost and moreover to set the area of contact between the side plate portion of the lower arm and the first connecting shaft at a large value to increase the strength to an applied load.

The above and other objects, features and advantages of the invention will become apparent from the following description of preferred embodiments taken in conjunction with the accompanying drawings.

BRIEF DESCRIPTION OF THE DRAWINGS

FIGS. 1 to 4 illustrate a first embodiment of the present invention, wherein FIG. 1 is a side view of a pantagraph type jack according to the first embodiment of the present invention;

FIG. 2 is an enlarged sectional view taken along a line 2—2 in FIG. 1;

FIG. 3 is an enlarged sectional view taken along a line 3—3 in FIG. 1;

FIG. 4 is a perspective view illustrating a connecting shaft during caulking thereof;

FIGS. 5 and 6 illustrates a second embodiment of the present invention, wherein FIG. 5 is a side view similar to FIG. 1;

FIG. 6 is an enlarged sectional view taken along a line 6—6 in FIG. 1;

FIGS. 7 and 8 illustrate a third embodiment of the present invention, wherein FIG. 7 is a side view of a Y-type jack; and FIG. 8 is an enlarged sectional view taken along a line 8—8 in FIG. 7.

DESCRIPTION OF THE PREFERRED EMBODIMENTS

The present invention will now be described by way of preferred embodiments in connection with the accompanying drawings.

Figure 1:
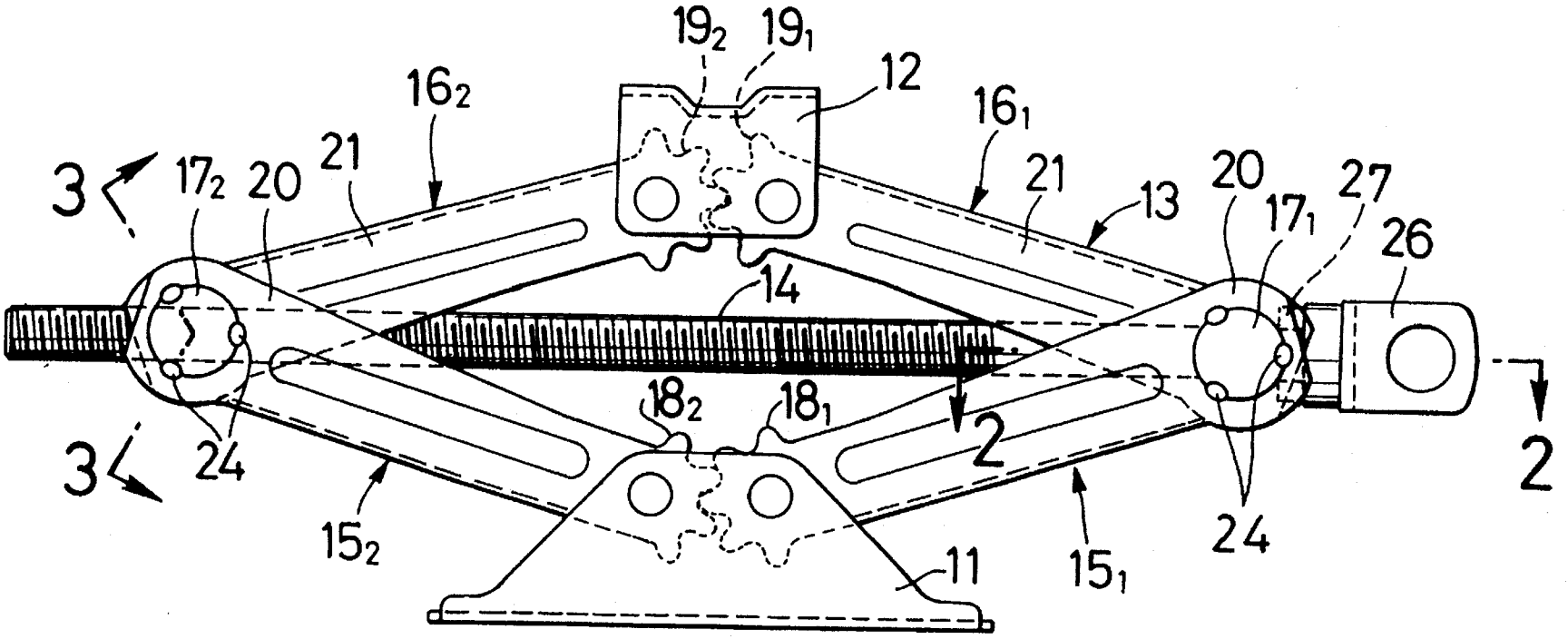

FIG. 1 shows a so-called pantagraph type jack. This jack includes four link arms connected to one another in a pantagraphic form. The jack further includes a pedestal 11, a load receiving block 12, a link mechanism 13 interposed between the pedestal 11 and the load receiving block 12 for liftably connecting the load receiving block 12 to the pedestal 11, and a threaded rod 14 for lifting and lowering the load receiving block 12 through the link mechanism 13.

The link mechanism 13 includes a pair of left and right lower arms $\mathbf{15}_1$ and $\mathbf{15}_2$ swingably connected at their lower ends to the pedestal 11, and a pair of left and right upper arms $\mathbf{16}_1$ and $\mathbf{16}_2$ swingably connected at their lower ends to upper ends of the lower arms $\mathbf{15}_1$ and $\mathbf{15}_2$ and at their upper ends to the load receiving block 12. The upper end of one of the lower arms $\mathbf{15}_1$ and the lower end of one of the upper arms $\mathbf{16}_1$ are connected to each other through a connecting shaft $\mathbf{17}_1$, so that the lower and upper arms $\mathbf{15}_1$ and $\mathbf{16}_1$ can be relatively swung. And the upper end of the other lower arm $\mathbf{15}_2$ and the lower end of the other upper arm $\mathbf{16}_2$ are connected to each other through a connecting shaft $\mathbf{17}_2$, so that the lower and upper arms $\mathbf{15}_2$ and $\mathbf{16}_2$ can be relatively swung. The lower ends of the lower arms $\mathbf{15}_1$ and $\mathbf{15}_2$ are provided with sector gears $\mathbf{18}_1$ and $\mathbf{18}_2$ meshed with each other. And the upper ends of the upper arms $\mathbf{16}_1$ and $\mathbf{16}_2$ are provided with sector gears $\mathbf{19}_1$ and $\mathbf{19}_2$ meshed with each other.

The threaded rod 14 has an axis perpendicular to an axis of one $\mathbf{17}_1$ of the connecting shafts $\mathbf{17}_1$ and $\mathbf{17}_1$. One end of the threaded rod 14 is rotatably fitted to the connecting shaft $\mathbf{17}_1$. The threaded rod 14 is threadedly inserted through the other connecting shaft $\mathbf{17}_1$. Thus, the connecting shafts $\mathbf{17}_1$ and $\mathbf{17}_2$ can be moved toward and away from each other by rotating the threaded rod 14, thereby righting up the link mechanism 13 to lift the load receiving block 12, or tilting down the link mechanism 13 to lower the receiving block 12.

Figure 2:
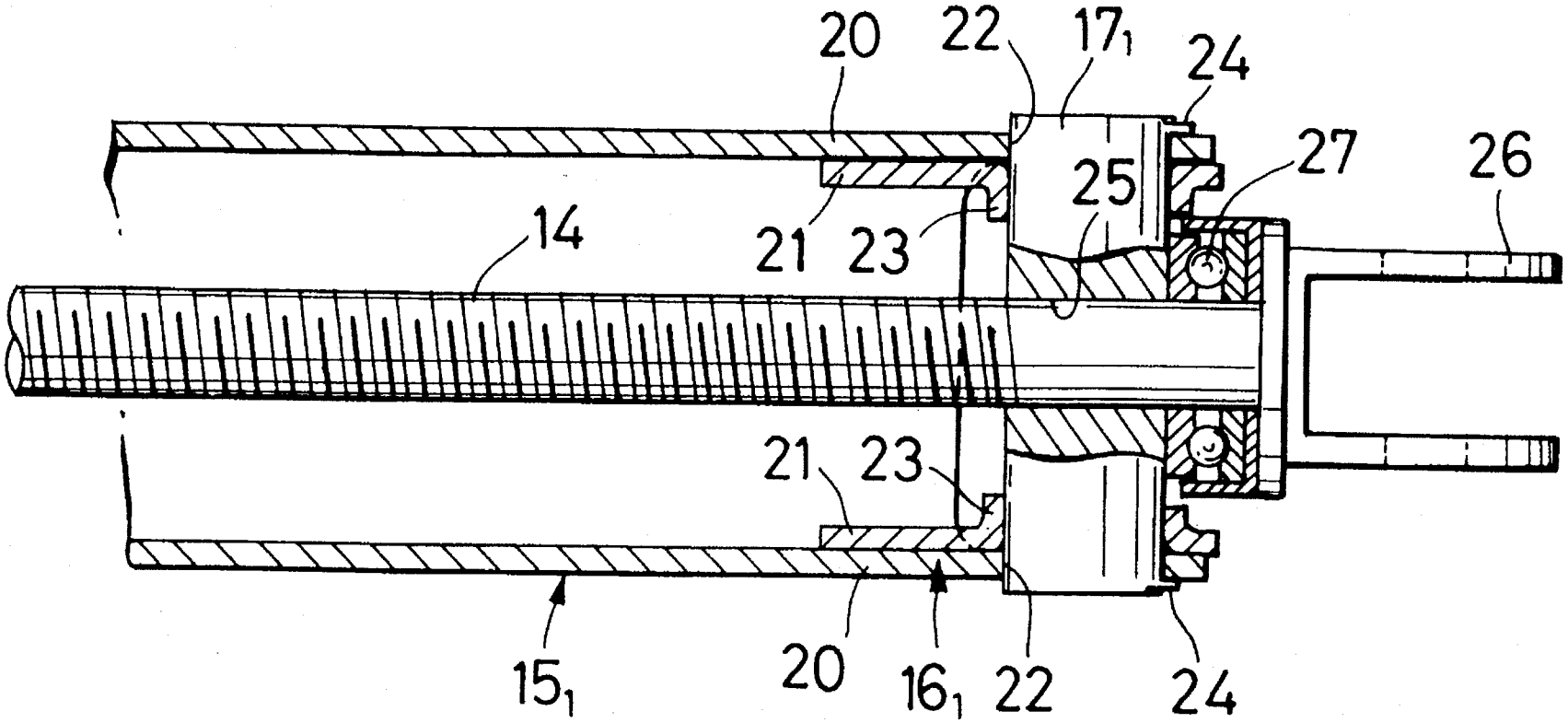
Figure 3:
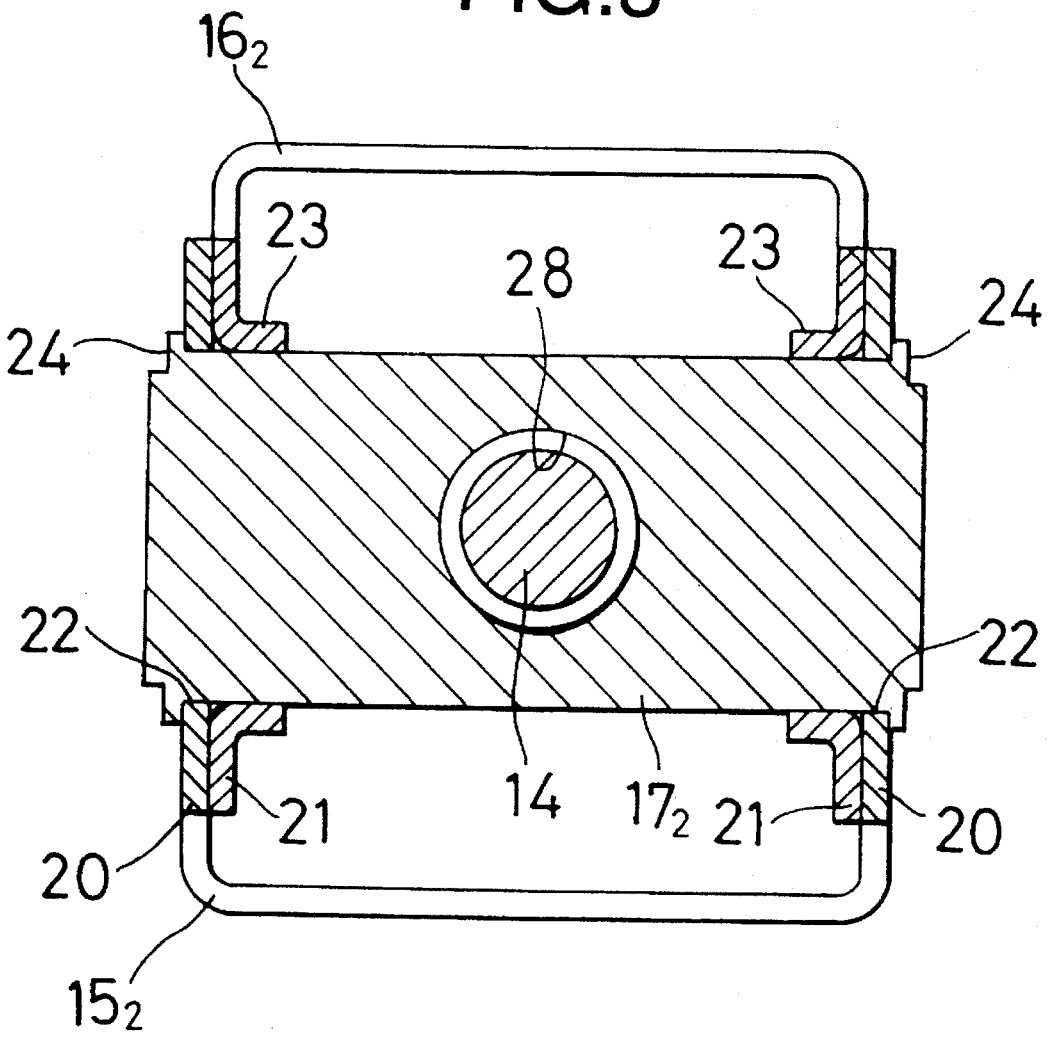

As shown in FIGS. 2 and 3, each of the lower arms $\mathbf{15}_1$ and $\mathbf{15}_2$ is formed so as to have an upwardly opened substantially U-shaped cross-sectional shape with a pair of side plate portions 20, 20 opposed to each other. And each of the upper arms $\mathbf{16}_1$ and $\mathbf{16}_2$ is formed so as to have a downwardly opened substantially U-shaped cross-sectional shape with a pair of side plate portions 21, 21 opposed to each other.

The side plate portions 20, 20 of the one lower arm $\mathbf{15}_1$ at its upper end and the side plate portions 21, 21 of the one upper arm $\mathbf{16}_1$ at its lower end are superposed on each other, such that the side plate portions 21, 21 are located at inner sides, as shown in FIG. 2. Each of the outer side plate portions 20, 20 is provided with an insertion hole 22. Each of the inner side plate portions 21, 21 has a support sleeve portion 23 coaxially aligned with the insertion hole 22 to extend inwardly. The support sleeve portion 23 is formed by burring so as to have an inside diameter equal to that of the insertion hole 22.

On the other hand, the connecting shaft $\mathbf{17}_1$ is formed into a rod-like shape with a uniform diameter over its axially entire length and inserted through the insertion holes 22, 22 and the support sleeve portions 23, 23. The connecting shaft $\mathbf{17}_1$ has bulged portions 24 formed at its opposite ends protruding radially outwardly from the outer side plate portions 20, 20 by caulking each of the opposite ends at a plurality of, e.g., three circumferential points. The bulged portions 24 are engaged with the side plate portions 20, 20 at peripheral edges of the insertion holes 22, 22.

The connecting shaft $\mathbf{17}_1$ is provided with a fitting hole 25 into which one end of the threaded rod 14 is fitted. The threaded rod 14 has a handle joint 26 integrally provided thereon, and a thrust bearing 27 is interposed between the handle joint 26 and the connecting shaft $\mathbf{17}_1$.

Referring to FIG. 3, the side plate portions 20, 20 at the upper end of the other lower arm $\mathbf{15}_2$ and the side plate portions 21, 21 at the lower end of the other upper arm $\mathbf{16}_2$ are superposed on each other, such that the side plate portions 21, 21 are located at inner sides. Each of the outer side plate portions 20, 20 has an insertion holes 22 provided therein, and each of the inner side plate portions 21, 21 has a support sleeve portion 23 coaxially aligned with the insertion hole 22 to extend inwardly and formed by burring. Moreover, the connecting shaft $\mathbf{17}_2$ is formed into a rod-like shape with a constant diameter over its axially entire length and inserted through the insertion holes 22, 22 and the support sleeve portions 23, 23. The connection shaft $\mathbf{17}_2$ has bulged portions 24 formed at its opposite ends protruding from the outer side plate portions 20, 20 by caulking the opposite ends. The bulged portions 24 are engaged with the side plate portions 20, 20 at peripheral edges of the insertion holes 22, 22. The connecting shaft $\mathbf{17}_2$ also has a threaded bore 28 provided therein, through which the threaded rod 14 is threadedly inserted.

Figure 4:
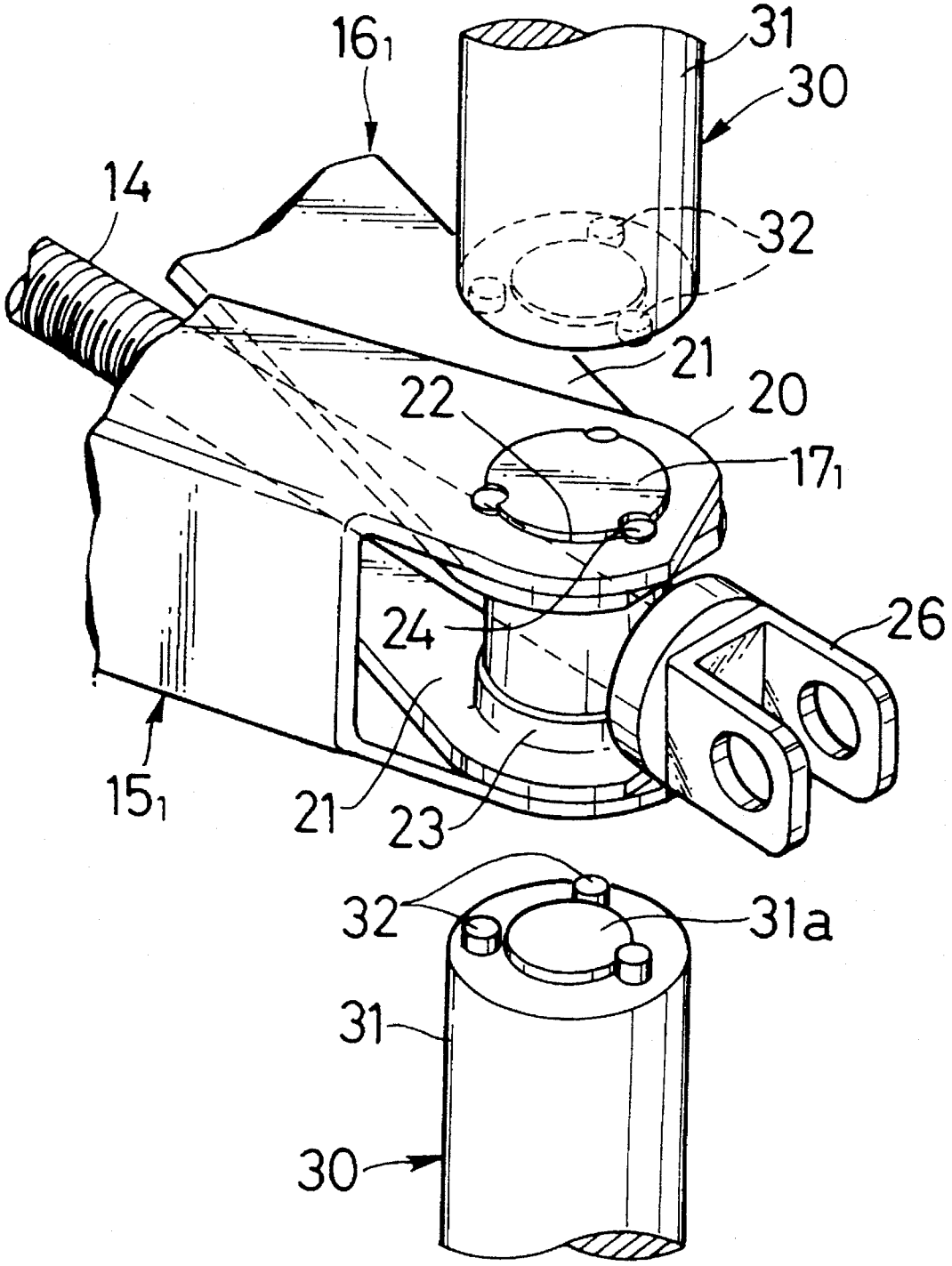

Referring to FIG. 4, for coupling the lower arm $\mathbf{15}_1$ and the upper arm $\mathbf{16}_1$ to the connecting shaft $\mathbf{17}_1$, a pair of caulking tools 30, 30 for caulking the opposite ends of the connecting shaft $17_1$ are used. Each of the caulking tools 30 includes a plurality of, e.g., three protrusions 32 projectingly provided at a tip end of a rod-like member 31 for forming the bulged portions 24 at the end of the connecting shaft $17_1$. The projected amount of each protrusion 32 measured from a tip end face 31*a* of the rod-like member 31 surrounded by the protrusions 32 is set at a value corresponding to a specified amount of caulking of the bulged portion 24.

The bulged portions 24 formed at the opposite ends of the connecting shaft $17_1$ are brought into engagement with the side plate portions 20, 20 respectively by impactively pressing the opposite ends of the connecting shaft $17_1$ inserted through the insertion holes 22, 22 and the support sleeve portions 23, 23 from the opposite sides by the caulking tools 30, 30. In this case, a force which may flex the side plate portions 20, 20 cannot be applied to the side plate portions 20, 20, thereby insuring a free rotation of the connecting shaft $17_1$, because the amount of caulking of the bulged portion 24 is determined at the specified value, as described above.

For coupling the second lower arm $15_2$ and the second upper arm $16_2$ to the connecting shaft $17_2$, the caulking using the caulking tools 30, 30 is also conducted in the same manner as that described above.

The operation of the first embodiment will be described below. The side plate portions 20, 20 provided on the lower arms $15_1$ and $15_2$ and the side plate portions 21, 21 provided on the upper arms $16_1$ and $16_2$ are superposed on each other with the side plate portions 20, 20 of the lower arms $15_1$ and $15_2$ being disposed at the outer side. And the bulged portions 24 formed by caulking at the opposite ends of the connection shafts $17_1$ and $17_2$ formed at the equal diameter over the entire axial length to extend through the side plate portions 21, 21 are engaged with the outer side plate portions 20, 20. Therefore, each of the connecting shafts $17_1$ and $17_2$ is of a simple shape. Thus, it is possible to easily produce a large number of the connecting shafts $17_1$ and $17_2$ each having a simple shape, leading to a reduction in manufacturing cost.

Moreover, the supporting sleeve portions 23, 23 extending inwardly are formed on the inner side plate portions 21, 21 by burring and the connecting shafts $17_1$ and $17_2$ are inserted through the supporting sleeve portions 23, 23. Therefore, it is possible to set the area of contact between the upper arms $16_1$ and $16_2$ and the connecting shafts $17_1$ and $17_2$ at a large value to increase the strength of the upper arms $16_1$ and $16_2$ with respect to a load applied thereto. And it is also possible to reliably prevent the upper arms $16_1$ and $16_2$ from being fallen down inwardly in the axial direction of the connecting shafts $17_1$ and $17_2$ when the applied load is increased.

Figure 5:
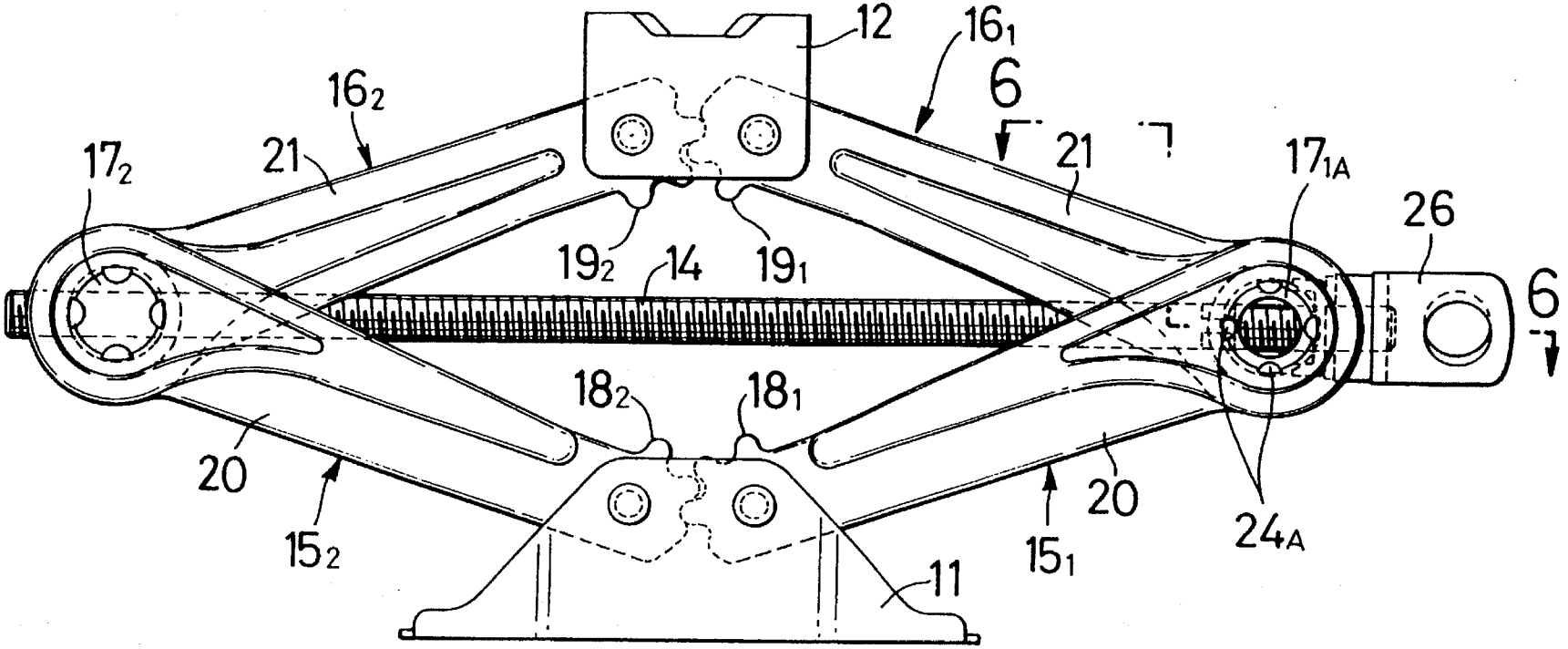
Figure 6:
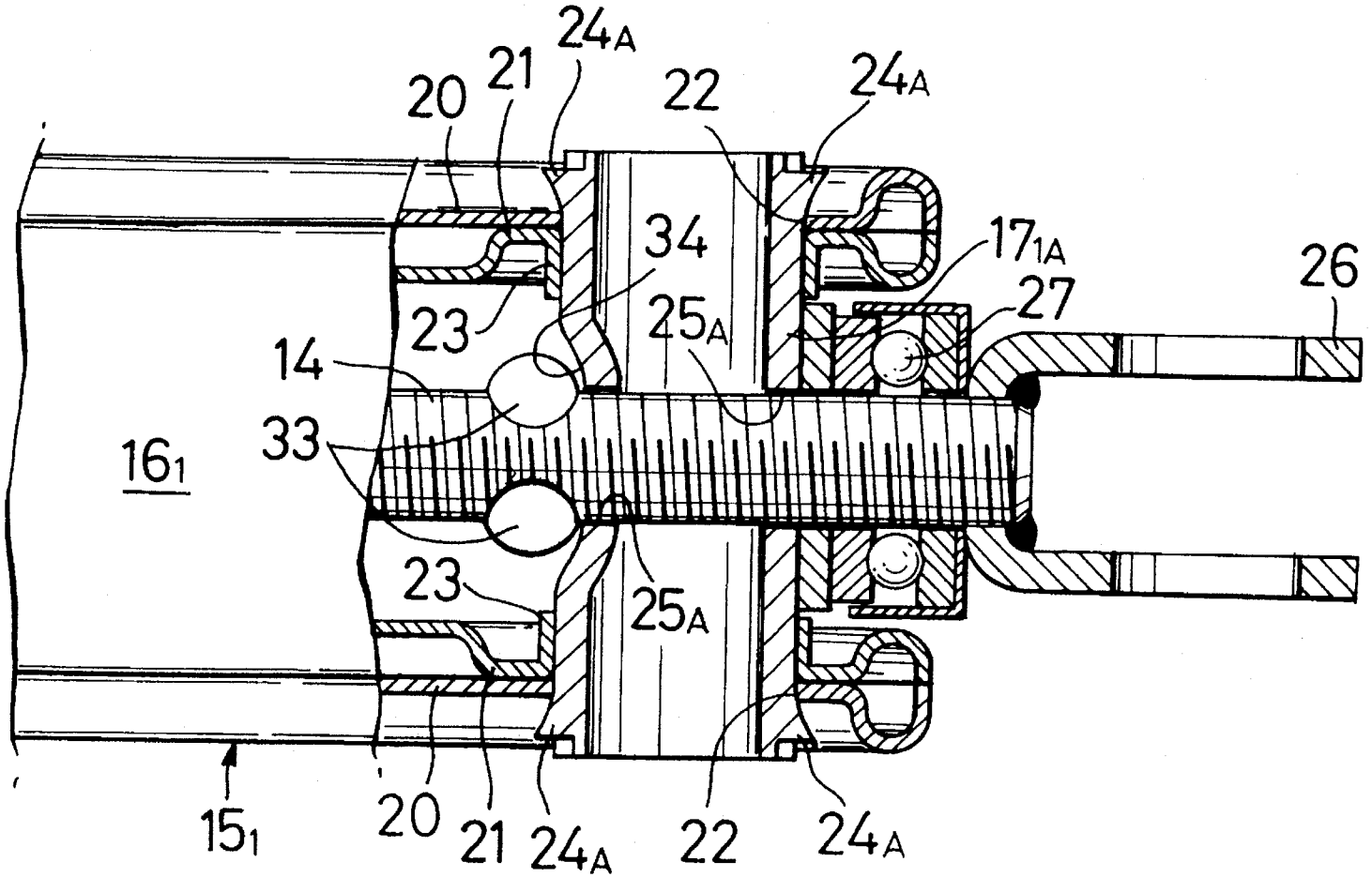

FIGS. 5 and 6 illustrate a second embodiment of the present invention, wherein portions or components corresponding to those in the first embodiment are designated by like reference characters.

In this pantagraph type jack, an upper end of one of lower arms $15_1$ and a lower end of one of upper arms $16_1$ are connected to each other through a connecting shaft $17_{1A}$. One end of a threaded rod 14 having an axis perpendicular to an axis of the connecting shaft $17_{1A}$ is rotatably but axially relatively non-movably fitted into the connecting shaft $17_{1A}$. And the threaded rod 14 is threadedly inserted through a connecting shaft $17_2$ which connects an upper end of the other lower arm $15_2$ and a lower end of the other upper arm $16_2$.

The connecting shaft $17_{1A}$ is formed into a hollow cylindrical shape with an outside diameter substantially uniform over the entire axial length. The connection shaft $17_{1A}$ is formed, at its opposite ends protruding from the outer side plate portions 20, 20, with bulged portions $24_A$ by caulking of a plurality of, e.g., four circumferential points. These bulged portions $24_A$ are engaged with the side plate portions 20, 20 at peripheral edges of insertion holes 22, 22.

Fitting holes $25_A$, $25_A$ are provided in the connecting shaft $17_{1A}$ such as to cross, at right angles, with an axis of the connecting shaft $17_{1A}$. One end of the threaded rod 14 is fitted into the fitting holes $25_A$, $25_A$. Further, a plurality of radially protruding stoppers 33 are formed by caulking at circumferentially spaced apart locations on the threaded rod 14, such that the connecting shaft $17_{1A}$ is sandwiched between a thrust bearing 27 and the stoppers 33. Receiving seats 34 are formed by pressing at those portions of the connecting shaft $17_{1A}$ which correspond to the stoppers 33, such that the receiving seats 34 are recessed radially inwardly to permit the rotation of the stoppers 33 with the rotation of the threaded rod 14.

According to the second embodiment, in addition to the effect of the first embodiment, the hollow cylindrical shape of the connecting shaft $17_{1A}$ ensures that a reduction in weight of the connecting shaft $17_{1A}$ and thus, a reduction in weight of the entire jack can be achieved. Moreover, the receiving seats 34 for receiving the stoppers 33 of the threaded rod 14 in order to maintain constant the axial position of the threaded rod 14 relative to the connecting shaft $17_{1A}$ can extremely easily be formed by pressing, because the connecting shaft $17_{1A}$ is of the hollow cylindrical shape. The stoppers 33 of the threaded rod 14 can also extremely easily be formed by caulking.

Figure 7:
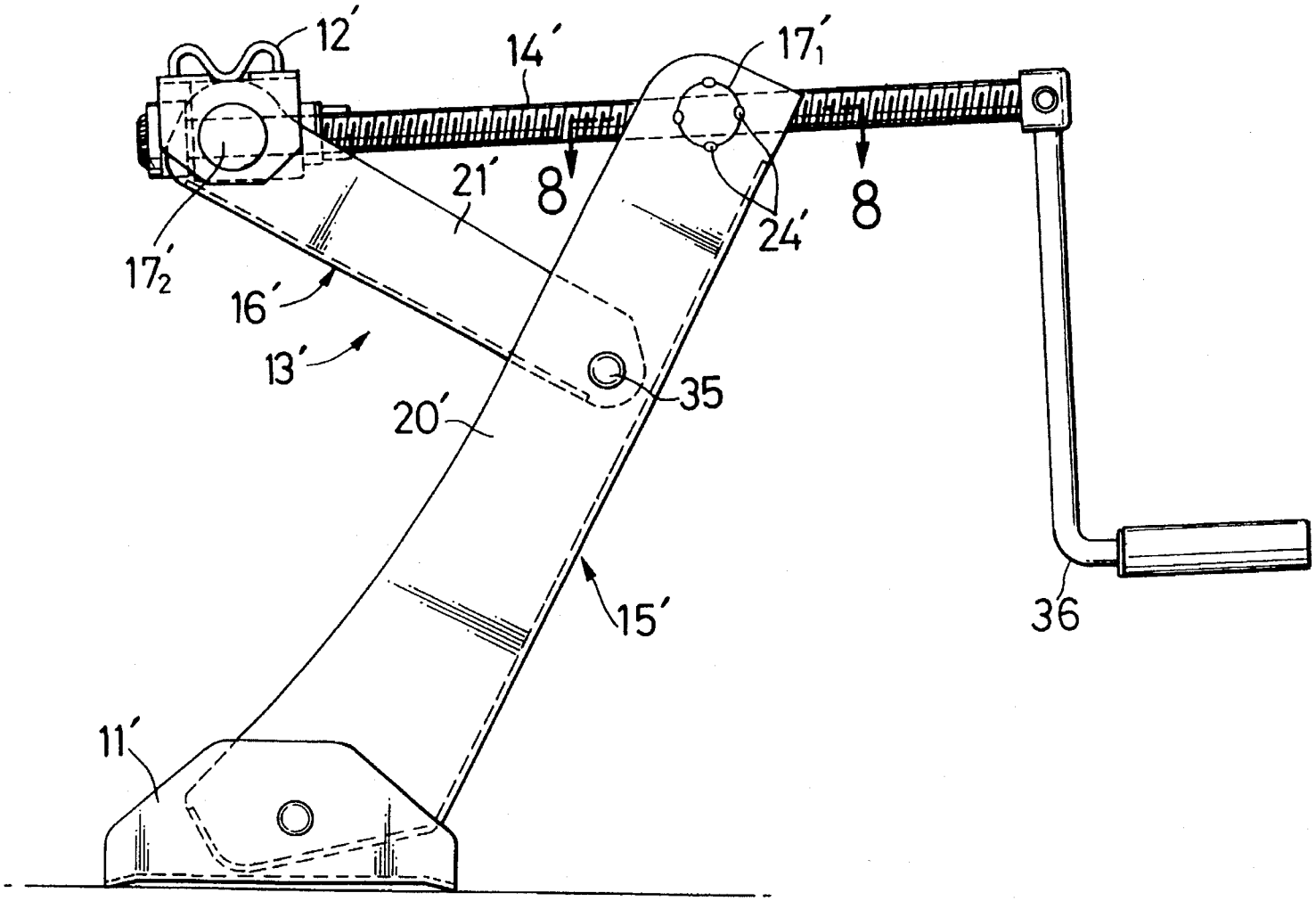
Figure 8:
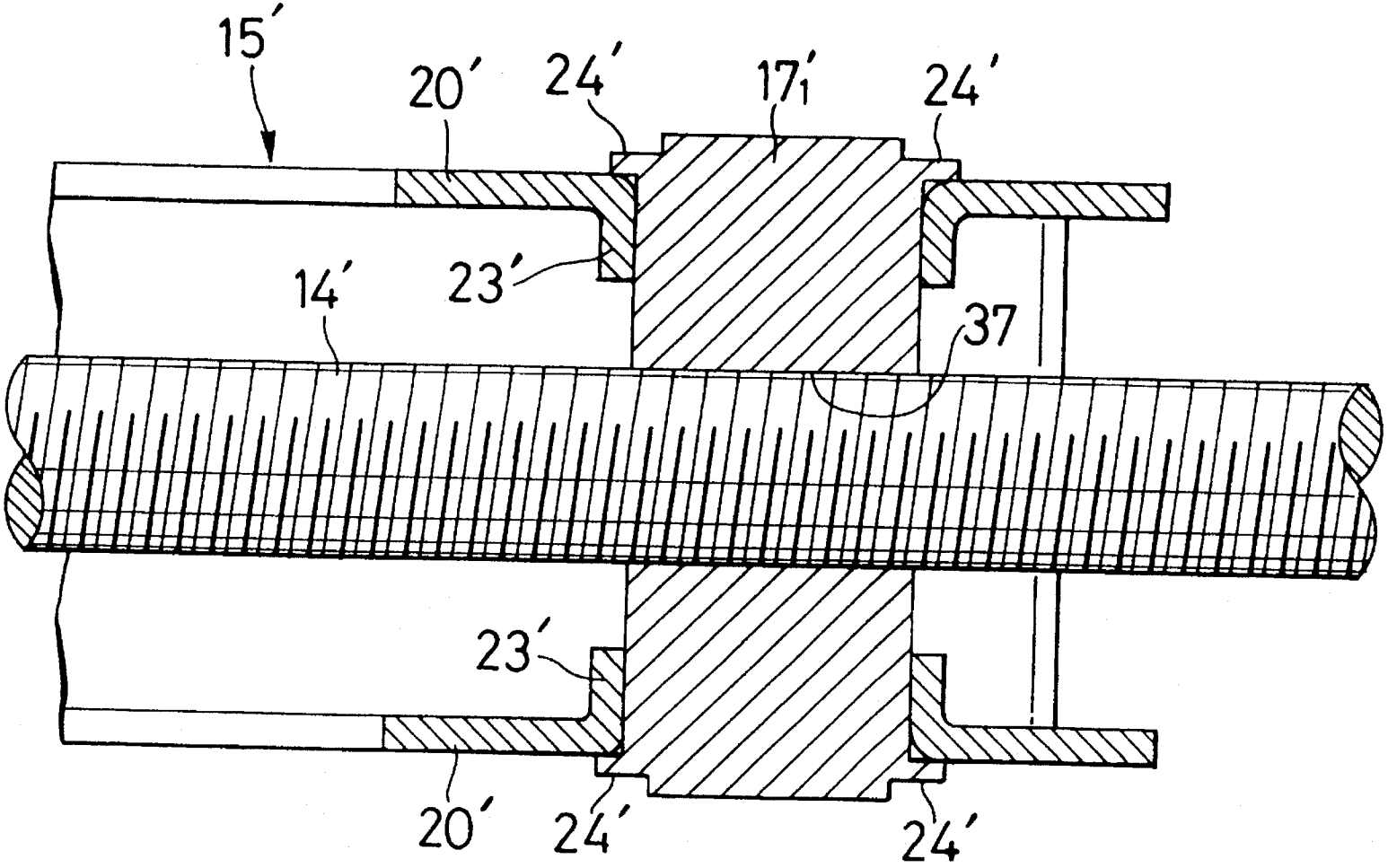

FIGS. 7 and 8 illustrate a third embodiment of the present invention. FIG. 7 is a side view of a Y-type jack, and FIG. 8 is an enlarged sectional view taken along a line 8—8 in FIG. 7.

This jack is so-called a Y-type jack with two link arms connected in a Y-shaped fashion, and includes a pedestal 11', a load receiving block 12', a link mechanism 13' interposed between the pedestal 11' and the load receiving block 12' for liftably connecting the load receiving block 12' to the pedestal 11', and a threaded rod 14' for lifting and lowering the load receiving block 12' through the link mechanism 13'.

The link mechanism 13' includes a single lower arm 15' swingably connected at its lower end to the pedestal 11', and a single upper arm 16' swingably connected at its lower end to an intermediate portion of the lower arm 15' closer to an upper end of the latter and having the load receiving block 12' provided at an upper end of the upper arm 16'.

The lower arm 15' is formed into a substantially U-shaped cross-sectional shape opened toward the upper arm 16' and includes a pair of side plate portions 20', 20' opposed to each other. The upper arm 16' is formed into a substantially U-shaped cross-sectional shape opened toward the lower arm 15' and includes a pair of side plate portions 21' opposed to each other. The opposite side plate portions 21' at one end of the upper arm 16' are superposed on the side plate portions 20', 20' at the intermediate portion of the lower arm 15' to lie at an inner side. The lower end of the upper arm 16' is pivotally connected to the intermediate portion of the lower arm 15' by a support pivot 35 which passes through the superposed side plate portions 20', 20' and 21'.

A first connecting shaft $17_1'$ having an axis parallel to the support pivot 35 is mounted at the upper end of the lower arm 15' for rotation about the axis. A second connecting shaft $17_2'$ having an axis parallel to the first connecting shaft $17_1'$ is rotatably mounted at the upper end of the upper arm 16'. The threaded rod 14' is provided at its one end with an operating handle 36, and is threadedly inserted into the first connecting shaft $17_1$'. The other end of the threaded rod 14' is rotatably and relatively axially non-movably fitted into the second connecting shaft $17_2$'. Thus, the first and second connecting shafts $17_1$' and $17_2$' can be moved toward and away from each other by rotating the threaded rod 14', thereby raising up the link mechanism 13' to lift the load receiving block 12', or tilting down the link mechanism 13' to lower the load receiving block 12'.

As shown in FIG. 8, supporting sleeve portions 23', 23' are formed by burring on a pair of opposed side plate portions 20', 20' at the upper end of the lower arm 15' respectively to extend toward each other, i.e., inwardly. The first connecting shaft $17_1$' is formed into a rod-like shape having a uniform diameter over the entire axial length and inserted through the support sleeve portions 23', 23'. The first connecting shaft $17_1$' has bulged portions 24' formed at its opposite ends protruding from the opposite side plate portions 20', 20' by caulking the opposite ends at a plurality of, e.g., four circumferential points and engaged with outer surfaces of the side plate portions 20', 20'. The first connecting shaft $17_1$' is also provided with a threaded bore 37, into which the threaded rod 14' is threadedly inserted.

According to the third embodiment, since the bulged portions 24' formed by caulking at the opposite ends of the first connecting shaft $17_1$' having the uniform diameter over the entire axial length to pass through the side plate portion 20', 20' are engaged with the side plate portions 20', 20', it is possible to simplify the shape of the first connecting shaft $17_1$' to reduce the manufacture cost. In addition, since the supporting sleeve portions 23', 23' extending inwardly are formed on the side plate portions 20', 20' by burring and the first connecting shaft $17_1$' is inserted through the supporting sleeve portions 23', 23', it is possible to set the area of contact between the lower arm 15' and the first connecting shaft $17_1$' at a large value to increase the strength of the lower arm 15' with respect to a load applied thereto. And it is also possible to reliably prevent the lower arm 15' from being fallen down axially inwardly of the first connecting shaft $17_1$' when the applied load is increased.

Although the embodiments of the present invention have been described in detail, it will be understood that the present invention is not limited to the above-described embodiments, and various modifications in design may be made without departing from the spirit and scope of the invention defined in claims.

What is claimed is:

1. A jack comprising:

a pair of lower arms swingably connected at their lower ends to a pedestal;

a pair of upper arms connected at their lower ends to upper ends of said lower arms through a pair of connecting shafts, respectively and having a load receiving block at upper ends of said upper arms; and a threaded rod fitted into one of said connecting shafts with an axial relative position maintained constant and threadedly inserted in the other connecting shaft such that the pair of connecting shafts interconnecting said lower and upper arms can move toward and away from each other, wherein each of the upper end of said lower arm and the lower end of said upper arm is provided with a pair of side plate portions, the pairs of side plate portions being superposed on each other, an outer one of the side plate portions having an insertion hole, an inner one of the side plate portions having an integral support sleeve portion which is coaxially aligned with the insertion hole to extend inwardly, each of said connecting shafts being formed to have a uniform outer diameter over its entire axial length and inserted through said insertion hole and said support sleeve portion, and each of said connecting shafts having bulged portions integrally formed at the opposite ends of said connecting shafts, the bulged portions being projected from one of the outer side plate portions and engaging with said one of the outer side plate portions.

2. A jack according to claim 1, wherein said connecting shaft, into which said threaded rod is fitted with its axial relative position maintained constant, is formed into a hollow cylindrical shape.

3. A jack according to claim 2, further including a thrust bearing interposed between said hollow cylindrical connecting shaft and a handle joint provided at one end of said threaded rod, and a receiving seat formed, by pressing, into a radially inwardly recessed shape on an outer surface of said connecting shaft on an opposite side from said thrust bearing for receiving a stopper projectingly provided on said threaded rod, such that the rotation of said stopper generated by the rotation of said threaded rod is permitted.

4. A jack according to claim 3, wherein said stopper is formed by caulking to protrude from an outer surface of said threaded rod.

* * * * *